US010627755B2

(12) United States Patent
Pan et al.

(10) Patent No.: US 10,627,755 B2
(45) Date of Patent: Apr. 21, 2020

(54) FUSER DEVICE AND IMAGE FORMING APPARATUS

(71) Applicant: KABUSHIKI KAISHA TOSHIBA, Minato-ku (JP)

(72) Inventors: Shanying Pan, Chigasaki (JP); Takayuki Masunaga, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 16/294,478

(22) Filed: Mar. 6, 2019

(65) Prior Publication Data

US 2019/0294088 A1 Sep. 26, 2019

(30) Foreign Application Priority Data

Mar. 20, 2018 (JP) ..... 2018-053195

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2042; G03G 15/205; G03G 15/2007; G03G 15/2039; H05B 3/26; H05B 2203/005
See application file for complete search history.

(56) References Cited

U.S. PATENT DOCUMENTS

2004/0228667 A1* 11/2004 Eskey ..... G03G 15/2042 399/334
2009/0102911 A1* 4/2009 Koroishi ..... B41J 2/33525 347/206
2016/0085187 A1 3/2016 Takagi
2016/0085188 A1 3/2016 Takagi
2017/0060054 A1 3/2017 Tress et al.
2017/0075266 A1* 3/2017 Mochizuki ..... G03G 15/2039
2017/0102650 A1* 4/2017 Shimura ..... G03G 15/2053
2017/0364004 A1* 12/2017 Takagi ..... G03G 15/2057
(Continued)

FOREIGN PATENT DOCUMENTS

JP 6-194993 7/1994
JP 2001-255772 9/2001
JP 2004-226557 8/2004
(Continued)

*Primary Examiner* — Francis C Gray
(74) *Attorney, Agent, or Firm* — Oblon, McClelland, Maier & Neustadt, L.L.P.

(57) ABSTRACT

A fuser device according to an embodiment includes a substrate, a first conductor, second conductors, a first wire, second wires, heating elements, and a roller. The first conductor extends in a first direction. The second conductors are apart from the first conductor in a second direction that is along a surface of the substrate and intersects the first direction, and are aligned with spacing in the first direction. At least one of the second conductors is provided with an opening. The first wire on the surface connected to the first conductor. The second wires on the surface are apart from the first wire and connected to the second conductors. The heating elements are apart from the second wires, apart from one another, and connected to the second conductors and the first conductor. The heating elements each generate heat by an applied current.

9 Claims, 8 Drawing Sheets

(56) References Cited

U.S. PATENT DOCUMENTS

| | | | |
|---|---|---|---|
| 2018/0052411 | A1 | 2/2018 | Takagi |
| 2018/0067428 | A1 | 3/2018 | Takagi |

FOREIGN PATENT DOCUMENTS

| | | |
|---|---|---|
| JP | 2016-65914 | 4/2016 |
| JP | 2016-65915 | 4/2016 |
| JP | 2016-90606 | 5/2016 |
| JP | 2017-45049 | 3/2017 |

* cited by examiner

FUSER DEVICE AND IMAGE FORMING APPARATUS

CROSS-REFERENCE TO RELATED APPLICATIONS

This application is based upon and claims the benefit of priority from Japanese Patent Application No. 2018-053195, filed on Mar. 20, 2018; the entire contents of which are incorporated herein by reference.

FIELD

An embodiment described herein relates generally to a fuser device and an image forming apparatus.

BACKGROUND

Image forming apparatuses include fuser devices that fuse toner images to media such as paper sheets. Such a fuser device includes, for example, a heater that heats a sheet on which a toner image has been generated and a roller that applies pressure to the heated sheet. The fuser device heats and presses the medium to fix the toner image onto the medium. Heaters that can change a region to heat in accordance with the size of the medium are known.

However, such a heater may vary in temperature in a main scanning direction, for example.

DETAILED DESCRIPTION

According to one embodiment, a fuser device includes a substrate, a first conductor, a plurality of second conductors, a first wire, a plurality of second wires, a plurality of heating elements and a roller. The first conductor extends in a first direction. The plurality of second conductors are apart from the first conductor in a second direction, and aligned with spacing in the first direction, at least one of the second conductors being provided with an opening, the second direction being along one surface of the substrate and intersecting the first direction. The first wire is laid on the surface and connected to the first conductor. The plurality of second wires is laid on the surface, apart from the first wire, and connected to the second conductors. The plurality of heating elements is apart from the second wires, apart from one another, connected to the second conductors and the first conductor, and generates heat when applied with current. The roller applies pressure to a medium on which a toner image is generated, the medium being heated by at least one of the heating elements.

The following describes an embodiment with reference to FIGS. 1 to 8. In the present specification, constituent elements according to the embodiment and descriptions thereof are described with multiple expressions in some cases. The constituent elements and descriptions thereof described with multiple expressions may be described with expressions other than those described herein. In addition, constituent elements and descriptions thereof not described with multiple expressions may also be described with expressions other than those described herein.

Figure 1:
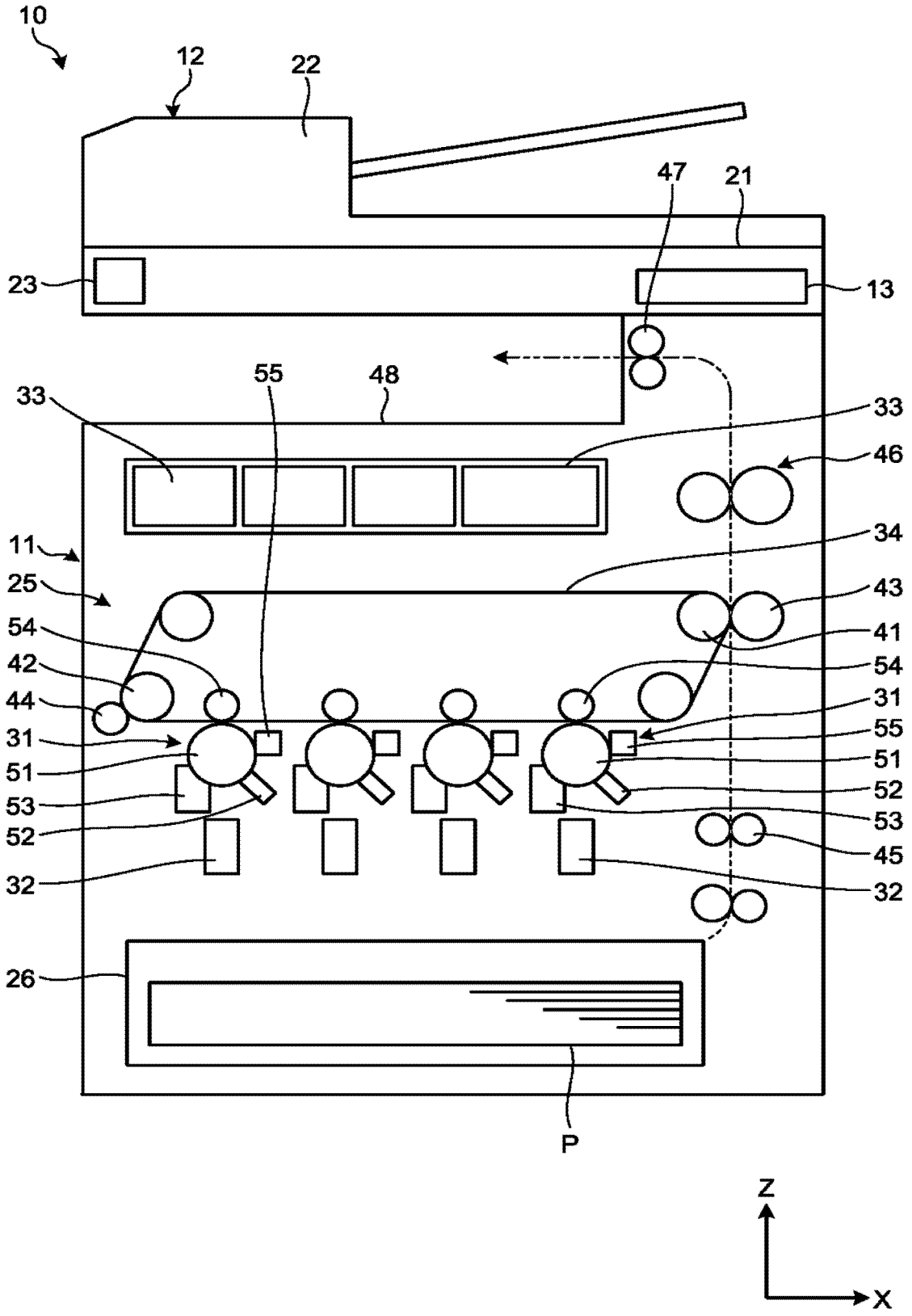
FIG. 1 is an exemplary diagram schematically illustrating an image forming apparatus in an embodiment.

FIG. 1 is an exemplary diagram schematically illustrating an image forming apparatus 10 in the embodiment. In the embodiment, the image forming apparatus 10 represents a multi-function peripheral (MFP). The image forming apparatus 10 may be a printer, a copying machine, or another device that generates an image on a medium.

The image forming apparatus 10 includes a body 11, a reader 12, and an operation unit 13. The reader 12 is disposed above the body 11, and includes a stage 21, an automatic document feeder 22, and an image sensor 23. The automatic document feeder 22 is disposed on the stage 21.

The image sensor 23 reads a document placed on the stage 21 or a document fed by the automatic document feeder 22 to produce image data. The image sensor 23 is disposed in a main scanning direction. The image sensor 23 reads the image on the document per page line by line.

The body 11 includes a printer 25 and a paper cassette 26. The paper cassette 26 is located under the printer 25 and can store a plurality of sheets P. The sheet P is an example of a medium. The medium may be another printable medium.

The printer 25 generates an image on the sheet P on the basis of an image read by the image sensor 23, an image input from an external device such as a personal computer, or an image stored in an information storage medium such as a memory card. The printer 25 represents a tandem color laser printer, for example. The printer 25 may be another printer.

The printer 25 includes four image forming units 31, four laser exposures 32, and four toner cartridges 33 corresponding to four colors of yellow (Y), magenta (M), cyan (C), and black (K), an intermediate transfer belt 34, a driving roller 41, a driven roller 42, a belt cleaner 44, paper feed rollers 45, a fuser device 46, carrier rollers 47, and a paper discharging unit 48. The four image forming units 31 are arranged along the intermediate transfer belt 34.

The image forming units 31 each include a photosensitive drum 51, a charger 52, a developer 53, a primary transfer roller 54, and a cleaner 55. The charger 52, the developer 53, the primary transfer roller 54, and the cleaner 55 are arranged around the photosensitive drum 51.

By irradiation of light from the laser exposures 32, electrostatic latent images are generated on the photosensitive drums 51. The chargers 52 uniformly charge the surfaces of the photosensitive drums 51. The developers 53 include, for example, developing rollers that supply a two-component developer containing toner and carrier to the photosensitive drums 51 for developing the electrostatic latent images. The cleaners 55 remove remnant toner on the photosensitive drums 51 with blades, for example.

The four toner cartridges 33 store the respective yellow (Y), magenta (M), cyan (C), and black (K) toners. The toner cartridges 33 supply the toners to the developers 53 of the image forming units 31.

The driving roller 41 and the driven roller 42 circulate the intermediate transfer belt 34. The intermediate transfer belt 34 passes between the photosensitive drums 51 and the primary transfer rollers 54 of the four image forming units 31. By applying a primary transfer voltage to the primary transfer rollers 54, toner images are primarily transferred from the photosensitive drums 51 to the intermediate transfer belt 34.

The intermediate transfer belt 34 passes between the driving roller 41 and a secondary transfer roller 43. By applying a secondary transfer voltage to the secondary transfer roller 43 when the sheet P passes between the driving roller 41 and the secondary transfer roller 43, the toner images are secondarily transferred from the intermediate transfer belt 34 to the sheet P. Remnant toner on the intermediate transfer belt 34 is removed by the belt cleaner 44.

The paper feed rollers 45 are located between the paper cassette 26 and the secondary transfer roller 43, and convey the sheet P extracted from the paper cassette 26. The fuser device 46 is located downstream of the secondary transfer roller 43 to fuse the toner images on the sheet P. The carrier rollers 47 are located downstream of the fuser device 46 to discharge the sheet P to the paper discharging unit 48.

Figure 2:
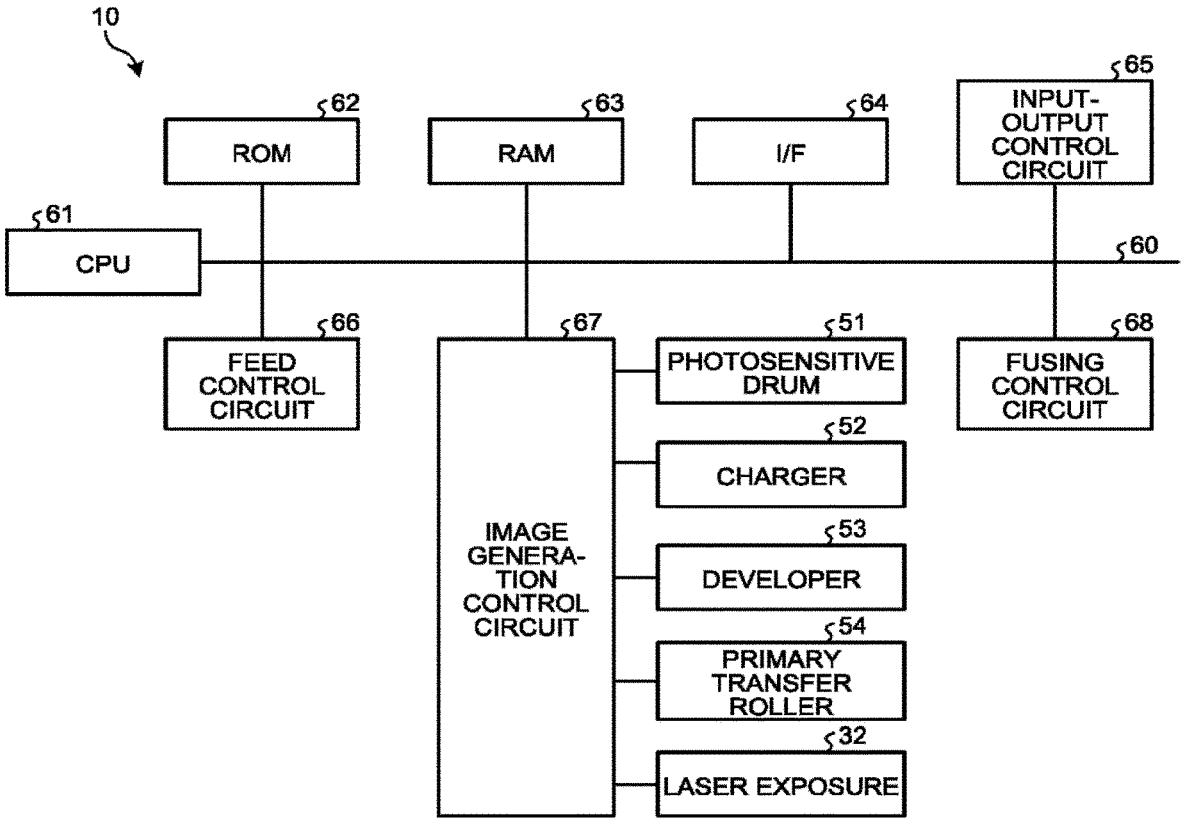
FIG. 2 is an exemplary block diagram illustrating an exemplary hardware configuration of the image forming apparatus in the embodiment.

FIG. 2 is an exemplary block diagram illustrating a hardware configuration of the image forming apparatus 10 in the embodiment. As illustrated in FIG. 2, the image forming apparatus 10 includes a central processing unit (CPU) 61, a read only memory (ROM) 62, a random access memory (RAM) 63, an interface (I/F) 64, an input-output control circuit 65, a feed control circuit 66, an image generation control circuit 67, and a fusing control circuit 68, which are coupled with one another via a bus 60, for example.

The CPU 61 is a computer that controls the overall processing of the image forming apparatus 10. The ROM 62 stores therein computer programs and data for implementing various types of processing by the CPU 61. The RAM 63 stores therein data necessary for various types of processing by the CPU 61. The I/F 64 is an interface that is coupled to external devices and external terminals via communication lines, for example, and exchanges data with the coupled external devices and external terminals.

The ROM 62 incorporates computer programs to be executed by the CPU 61 for implementing the various types of processing in advance, for example. The computer programs may be recorded in installable or executable file format and provided on a computer-readable recording medium such as a compact disc read only memory (CD-ROM), a floppy disk (FD), a compact disc recordable (CD-R), or a digital versatile disc (DVD).

The computer programs executed by the CPU 61 may be stored in a computer connected to a network such as the Internet and downloaded via the network. The computer programs may be provided or distributed via a network such as the Internet.

The input-output control circuit 65 controls the operation unit 13. The feed control circuit 66 controls a plurality of motors that drives the paper feed rollers 45, the carrier rollers 47 and the various rollers that carry the sheet P. The image generation control circuit 67 controls the laser exposures 32, the photosensitive drums 51, the chargers 52, the developers 53, and the primary transfer rollers 54. The fusing control circuit 68 controls the fuser device 46. The input-output control circuit 65, the feed control circuit 66, the image generation control circuit 67, and the fusing control circuit 68 are controlled by the CPU 61 in the embodiment, however, they may be individually controlled by arithmetic processing units therefor.

Figure 3:
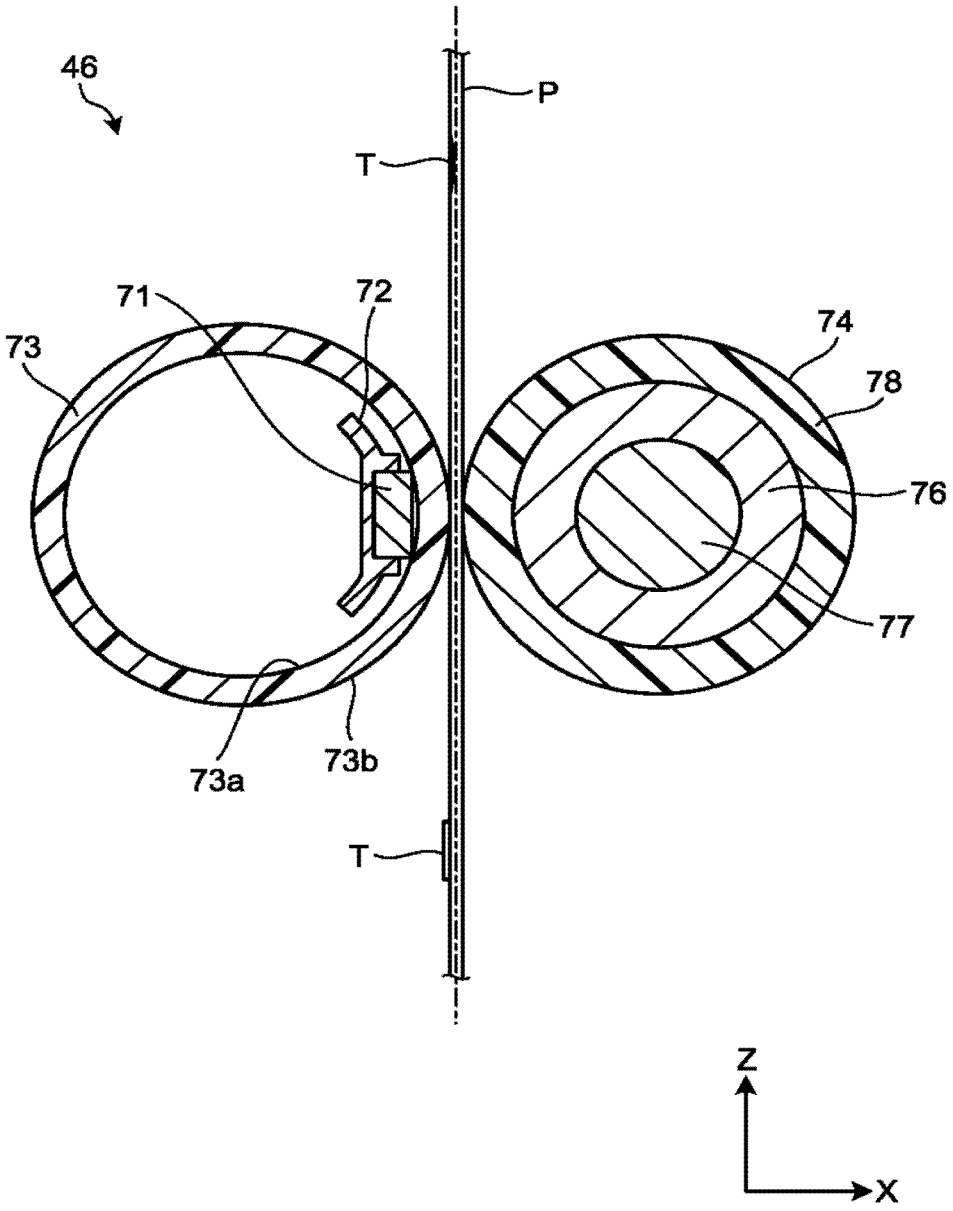
FIG. 3 is an exemplary cross-sectional view schematically illustrating a fuser device in the embodiment.

FIG. 3 is an exemplary cross-sectional view schematically illustrating the fuser device 46 in the embodiment. As illustrated in FIG. 3, the fuser device 46 includes a heater 71, a heater holder 72, a fusing belt 73, and a pressure roller 74. The pressure roller 74 is an exemplary roller.

The heater holder 72 holds the heater 71. The fusing belt 73 has a substantially cylindrical shape, surrounds the heater holder 72, and is rotatable around the heater holder 72. The fusing belt 73 has an inner surface 73*a* and an outer surface 73*b*. The heater 71 held by the heater holder 72 faces the inner surface 73*a* of the fusing belt 73. The fusing belt 73 is made from a heat resistant resin such as a polyimide resin, for example.

The pressure roller 74 includes a rotational body 76, a shaft 77, and a resin layer 78. The fusing control circuit 68 drives a motor connected to the shaft 77, to rotate the rotational body 76 about the shaft 77, for example. The resin layer 78 is made from a heat resistant resin such as a silicone resin, for example, and is laid on the outer surface of the rotational body 76. The pressure roller 74 is pressed onto the outer surface 73*b* of the fusing belt 73. The heater 71 faces the pressure roller 74 via the fusing belt 73.

The sheet P, on which toners image T have been secondarily transferred by the secondary transfer roller 43, passes between the fusing belt 73 and the pressure roller 74. While passing therebetween, the sheet P is heated by the heater 71 and pressed by the pressure roller 74. This heats and melts the toner images T on the surface of the sheet P to fix them to the sheet P.

Figure 4:
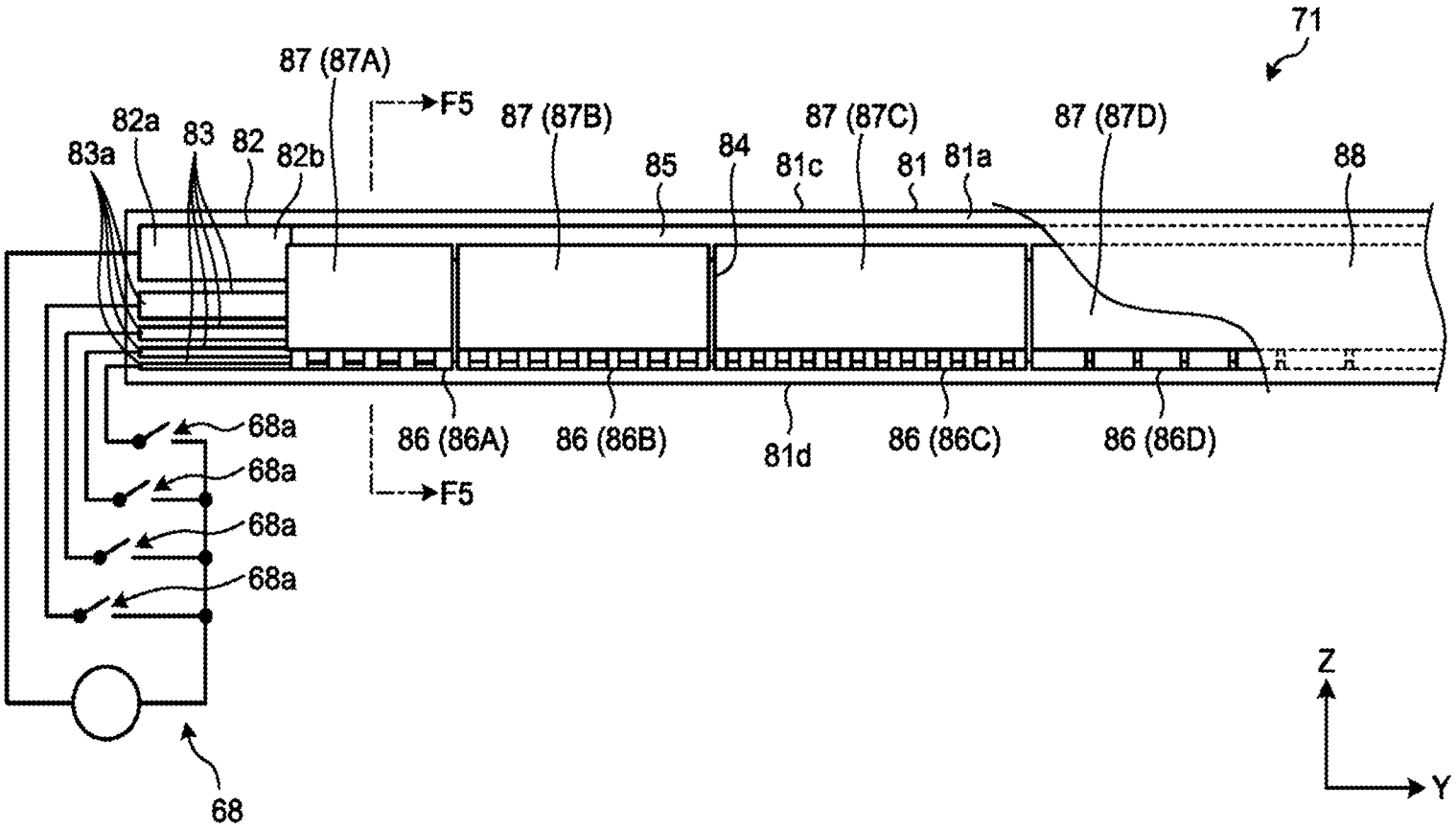
FIG. 4 is an exemplary plan view schematically illustrating a fusing control circuit and a heater in the embodiment.
Figure 5:
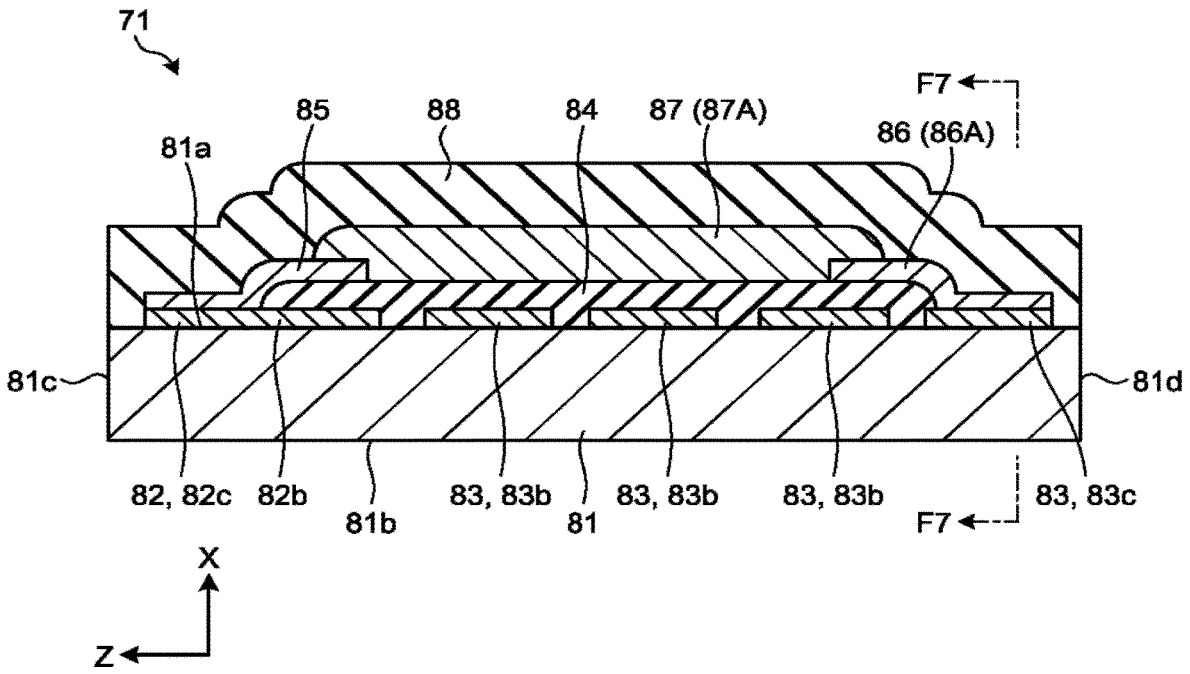
FIG. 5 is an exemplary schematic cross-sectional view of the heater in the embodiment, along the line F5-F5 in FIG. 4.

FIG. 4 is an exemplary plan view schematically illustrating the fusing control circuit 68 and the heater 71 in the embodiment. FIG. 5 is an exemplary schematic cross-sectional view of the heater 71 in the embodiment, along the line F5-F5 in FIG. 4. As illustrated in FIG. 5, the heater 71 includes a substrate 81, a first wire 82, a plurality of second wires 83, an insulation layer 84, a first conductor 85, a plurality of second conductors 86, a plurality of heating elements 87, and a protection layer 88.

As illustrated in each drawing, an X-axis, a Y-axis, and a Z-axis are defined in the specification. The X-axis, the Y-axis, and the Z-axis are orthogonal to one another. The X-axis is along the thickness of the heater 71. The Y-axis is along the length of the heater 71 and in the main scanning direction. The Z-axis is along the width of the heater 71.

The substrate 81 is made of a ceramic, for example, and has a rectangular plate shape extending in the Y-axis direction. The substrate 81 includes a first surface 81*a*, a second surface 81*b*, a first end 81*c*, and a second end 81*d*. The first surface 81*a* is an example of a surface.

The first surface 81*a* is substantially flat, facing in a positive X-axis direction (direction indicated by the arrow of the X-axis). The second surface 81*b* is substantially flat and opposite the first surface 81*a*, facing in a negative X-axis direction (the opposite direction of the direction indicated by the arrow of the X-axis).

The first end 81*c* is the end of the substrate 81 in a positive Z-axis direction (direction indicated by the arrow of the Z-axis). The second end 81*d* is the end of the substrate 81 in a negative Z-axis direction (opposite direction of the direction indicated by the arrow of the Z-axis). The second end

81*d* is opposite the first end 81*c*. The first end 81*c* and the second end 81*d* extend in the Y-axis direction substantially in parallel with each other.

The first wire 82 and the second wires 83 are laid on the first surface 81*a* of the substrate 81. The first wire 82 is earthed. The second wires 83 are applied with current under the control of the CPU 61.

Figure 6:
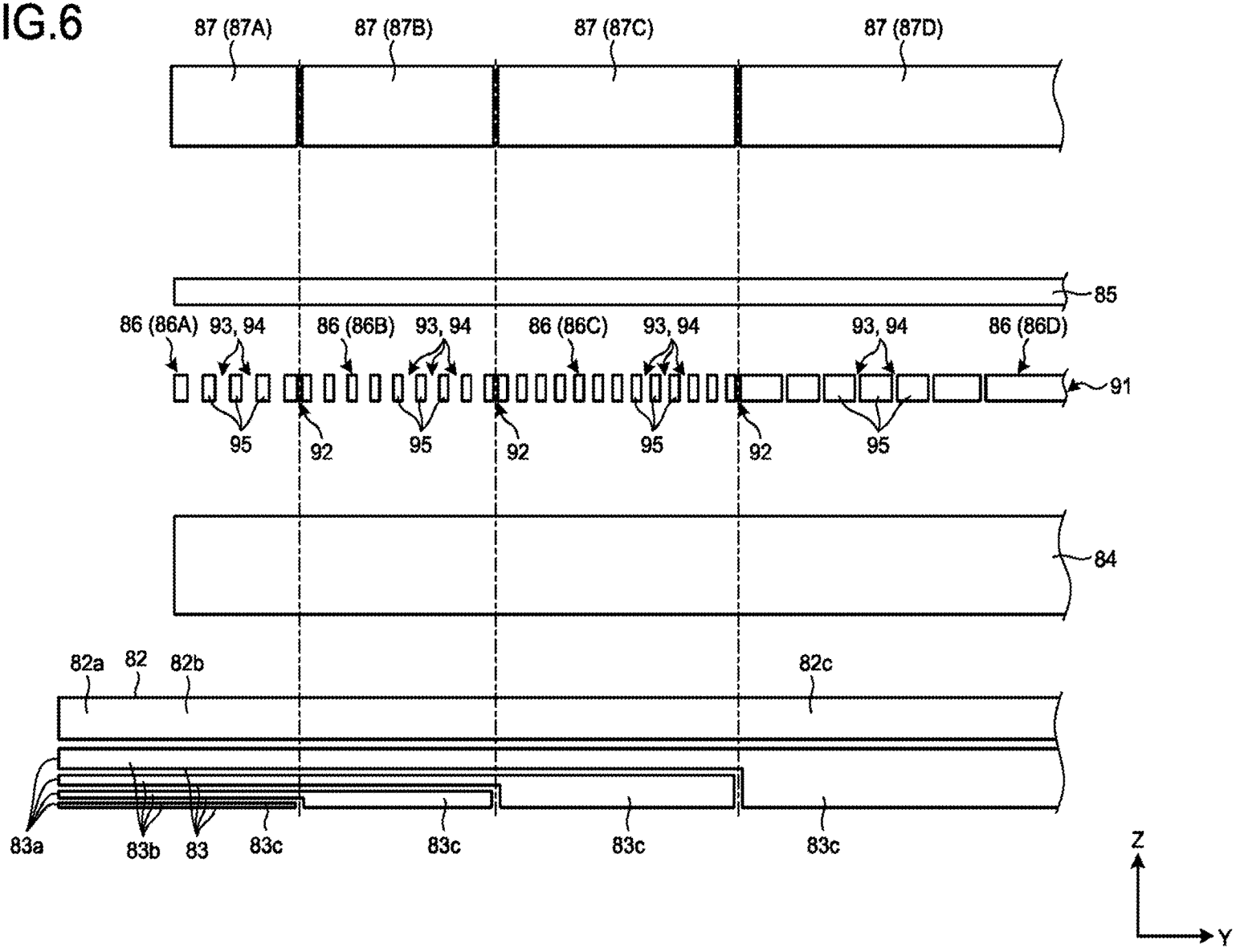
FIG. 6 is an exemplary exploded plan view schematically illustrating a first wire, second wires, an insulation layer, a first conductor, second conductors, and heating elements in the embodiment.

FIG. 6 is an exemplary exploded plan view schematically illustrating the first wire 82, the second wires 83, the insulation layer 84, the first conductor 85, the second conductors 86, and the heating element 87. As illustrated in FIG. 6, the first wire 82 includes a terminal 82*a*, a wire 82*b*, and an electrode 82*c*.

The terminal 82*a* is located at one end portion of the substrate 81 in the Y-axis direction. The wire 82*b* extends in the Y-axis direction and is connected to the terminal 82*a* and the electrode 82*c*. The electrode 82*c* extends along the first end 81*c*.

The second wires 83 are apart from the first wire 82 in the Z-axis direction. The second wires 83 are apart from one another. The second wires 83 each include a terminal 83*a*, a wire 83*b*, and an electrode 83*c*.

The terminals 83*a* are located at the one end portion of the substrate 81 in the Y-axis direction. The wires 83*b* extend in the Y-axis direction and are connected to the terminals 83*a* and the electrodes 83*c*. The electrodes 83*c* extend along the second end 81*d* and are connected to the corresponding second conductors 86.

The terminal 82*a* of the first wire 82 and the terminals 83*a* of the second wires 83 are aligned with spacing in the Z-axis direction. The electrodes 83*c* of the second wires 83 are aligned with spacing in the Y-axis direction.

As illustrated in FIG. 5, the insulation layer 84 covers the wire 82*b* of the first wire 82 and the wires 83*b* of the second wires 83. The terminal 82*a* and the electrode 82*c* of the first wire 82 and the terminals 83*a* and the electrodes 83*c* of the second wires 83 are not covered by the insulation layer 84 but exposed.

As illustrated in FIG. 6, the first conductor 85 extends in the Y-axis direction. The Y-axis direction is an example of a first direction. The Y-axis direction includes a positive Y-axis direction (direction indicated by the arrow of the Y-axis) and a negative Y-axis direction (opposite direction of the direction indicated by the arrow of the Y-axis). As illustrated in FIG. 5, one part of the first conductor 85 is connected to the electrode 82*c* of the first wire 82. The other part of the first conductor 85 covers a part of the insulation layer 84.

The second conductors 86 are apart from the first conductor 85 in the Z-axis direction. The Z-axis direction is along the first surface 81*a* of the substrate 81. The Z-axis direction is an example of a second direction. The Z-axis direction includes positive and negative Z-axis directions.

As illustrated in FIG. 6, the second conductors 86 are aligned with spacing in the Y-axis direction, forming a row 91. The second conductors 86 thus extend in the Y-axis direction as a whole. The widths of the second conductors 86 each are substantially equal to that of the first conductor 85 in the Z-axis direction.

Every two adjacent second conductors 86 are disposed with a gap 92. The gap 92 can also be referred to as an opening, a slit, a groove, or a clearance, for example. The gap 92 extends in the Z-axis direction to separate two adjacent second conductors 86. The gap 92 is aligned with a gap between every two adjacent electrodes 83*c* of the second wires 83 in the X-axis direction.

In the following, the second conductors 86 may be individually referred to as second conductors 86A, 86B, 86C, and 86D. Each of the second conductors 86A, 86B, 86C, and 86D is an example of a divided conductor. The second conductor 86A is an example of a first divided conductor. The second conductor 86B is an example of a second divided conductor. The second conductor 86C is an example of a third divided conductor.

The second conductor 86A is located at the end of the row 91. The second conductor 86B is adjacent to the second conductor 86A in the row 91. The second conductor 86C is adjacent to the second conductor 86B in the row 91. The second conductor 86B is thus located between the second conductors 86A and 86C.

The second conductor 86D is adjacent to the second conductor 86C in the row 91. The second conductor 86C is thus located between the second conductors 86B and 86D.

As illustrated in FIG. 5, each of the second conductors 86A, 86B, 86C, and 86D has a part that is connected to corresponding one of the electrodes 83*c* of the second wires 83. The other part of the second conductors 86A, 86B, 86C, and 86D covers part of the insulation layer 84.

As illustrated in FIG. 6, each of the second conductors 86A, 86B, 86C, and 86D is provided with an opening 93. The second conductors 86 may include at least one continuous second conductor 86 provided with no opening 93. The opening 93 includes a plurality of grooves 94. The grooves 94 may also be referred to as holes, slits, or clearances, for example. The grooves 94 extend in the Z-axis direction and divide each of the second conductors 86A, 86B, 86C, and 86D.

By the grooves 94, the second conductors 86A, 86B, 86C, and 86D are each divided into partial conductors 95. The partial conductors 95 are parts of the second conductors 86A, 86B, 86C, and 86D divided by the grooves 94. The partial conductors 95 are aligned in the Y-axis direction with the grooves 94 interposed therebetween. The grooves 94 are located between every two partial conductors 95.

In each of the second conductors 86A, 86B, and 86C, the grooves 94 are arranged at regular intervals in the Y-axis direction. In each of the second conductors 86A, 86B, and 86C, the grooves 94 are substantially the same in length in the Y-axis direction, and the partial conductors 95 are substantially the same in length in the Y-axis direction.

A ratio of the total size of the grooves 94 to the size of the second conductors 86 (open area ratio of the grooves 94) is larger than a ratio of the total size of the gaps 92 to the size of the second conductors 86 (open area ratio of the gaps 92). In the embodiment, the sum of the sizes of the grooves 94 matches the size of the opening 93 in the second conductor 86.

In the embodiment, the size of the groove 94 corresponds to a volume of the space between the two adjacent partial conductors 95 while the size of the gap 92 corresponds to a volume of the space between the two adjacent second conductors 86. For example, when the sum of the volumes of the grooves 94 is equal to the sum of the volumes of the second conductors 86, the open area ratio of the grooves 94 will be one.

Alternatively, the size of the groove 94 may correspond to an area of the space between the two adjacent partial conductors 95 in the X-axis direction while the size of the gap 92 may correspond to an area of the space between the two adjacent second conductors 86 in the X-axis direction. In this case, the open area ratio of the grooves 94 is also larger than the open area ratio of the gaps 92.

In the embodiment, a ratio of the total size of the grooves 94 of the second conductor 86B to the size of the second conductor 86B (open area ratio of the second conductor 86B) is larger than a ratio of the total size of the grooves 94 of the second conductor 86A to the size of the second conductor 86A (open area ratio of the second conductor 86A).

The open area ratio of the second conductor 86B is larger than a ratio of the total size of the grooves 94 of the second conductor 86C to the size of the second conductor 86C (open area ratio of the second conductor 86C). The open area ratio of the second conductor 86B is larger than a ratio of the total size of the grooves 94 of the second conductor 86D to the size of the second conductor 86D (open area ratio of the second conductor 86D).

The open area ratio of each of the second conductors 86A, 86B, and 86C is set to larger than one. The total size of the grooves 94 of the second conductors 86A, 86B, and 86C is thus larger than the total size of the partial conductors 95 of the second conductors 86A, 86B, and 86C. The open area ratio of each of the second conductors 86A, 86B, and 86C may be set to equal to or smaller than one.

The heating elements 87 are electrical resistances such as ceramic heaters that generate heat when applied with currents. The heating elements 87 have a substantially rectangular shape extending in the Y-axis direction or may also have another shape.

The heating elements 87 are aligned with spacing in the Y-axis direction. The heating elements 87 thus extend in the Y-axis direction as a whole. In other words, the single heating element 87 is divided in the Y-axis direction. The gap between every two adjacent heating elements 87 is aligned with the gap 92 and the gap between every two adjacent electrodes 83*c* of the second wires 83 in the X-axis direction.

As illustrated in FIG. 5, the heating elements 87 cover the insulation layer 84 and are connected to the first conductor 85 and the corresponding second conductors 86. The insulation layer 84 separates the heating elements 87 from the first wire 82 and the second wires 83. The heating elements 87 are thus apart from the first wire 82 and the second wires 83 via the insulation layer 84.

In the following, the heating elements 87 may be individually referred to as heating elements 87A, 87B, 87C, and 87D. The heating element 87A is an example of a first heating element. The heating element 87B is an example of a second heating element.

As illustrated in FIG. 6, the heating element 87A is connected to the second conductor 86A. The heating element 87B is connected to the second conductor 86B. The heating element 87C is connected to the second conductor 86C. The heating element 87D is connected to the second conductor 86D.

In the embodiment, the lengths of the heating elements 87 in the Y-axis direction are set in accordance with the sizes of the sheets P to be used. For example, the length of the heating element 87D is set to be able to heat the entire sheet P having an A5R size (148 mm×210 mm) in the main scanning direction (Y-axis direction). The sum of the lengths of the heating elements 87C and 87D is set to be able to heat the entire sheet P having an A4R size (210 mm×297 mm) in the main scanning direction. The sum of the lengths of the heating elements 87B, 87C, and 87D is set to be able to heat the entire sheet P having a B4 size (364 mm×257 mm) in the main scanning direction. The lengths of the heating elements 87 are not limited to such examples.

Figure 7:
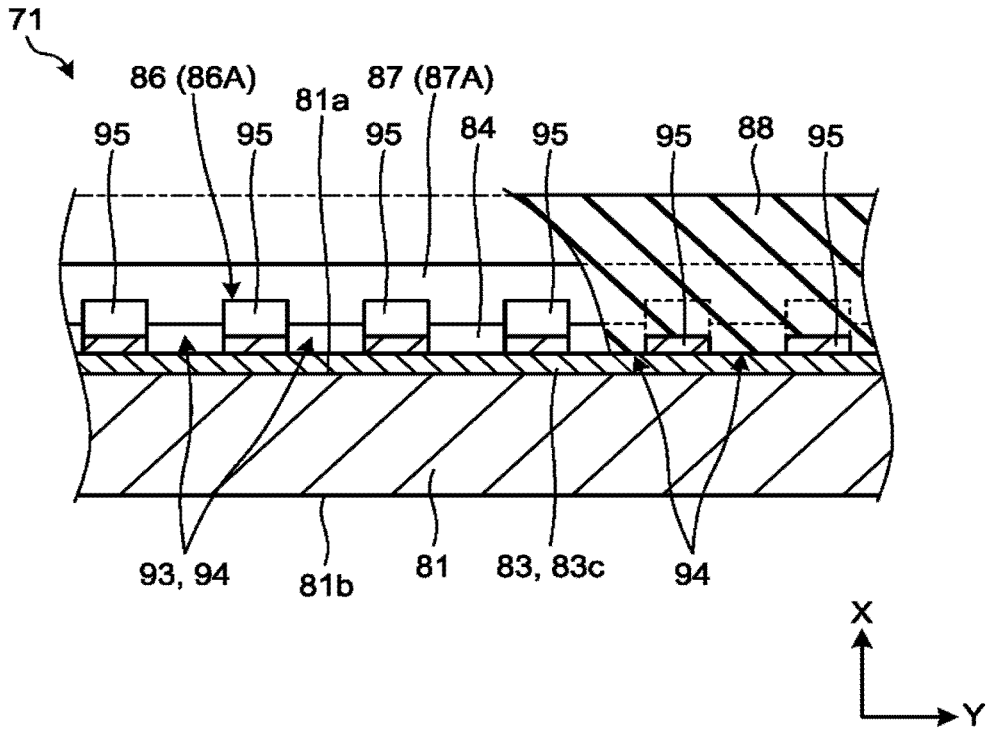
FIG. 7 is an exemplary schematic cross-sectional view of the heater in the embodiment, along the line F7-F7 in FIG. 5.

FIG. 7 is an exemplary schematic cross-sectional view of the heater 71 in the embodiment, along the line F7-F7 in FIG. 5. As illustrated in FIGS. 5 and 7, the protection layer 88 covers the first surface 81*a* of the substrate 81, the first wire 82, the second wires 83, the insulation layer 84, the first conductor 85, the second conductors 86, and the heating elements 87. The terminal 82*a* of the first wire 82 and the terminals 83*a* of the second wires 83 are not covered by the protection layer 88 but exposed. The protection layer 88 fills in the openings 93 in the second wires 83. That is, part of the protection layer 88 is located in the openings 93 between the two adjacent partial conductors 95.

As illustrated in FIG. 4, the exposed terminal 82*a* of the first wire 82 is electrically grounded, for example. The exposed terminals 83*a* of the second wires 83 are electrically connected to switching elements 68*a* of the fusing control circuit 68, for example. The fusing control circuit 68 can selectively apply a current to at least one of the second wires 83. The second wires 83 may be electrically connected to other elements such as field effect transistors (FETs) in place of the switching elements 68*a*.

A current applied to the second wires 83 flows to the corresponding heating elements 87 from the electrodes 83*c* of the second wires 83 through the corresponding second conductors 86. Applied with the current, the heating elements 87 generate heat. The current flows from the heating elements 87 to the first wire 82 through the first conductor 85.

The second wires 83 are connected in parallel. Thus, the second wires 83 are equally applied with a voltage. An alternating current voltage or a direct current voltage may be applied to the second wires 83.

The image forming apparatus 10 fuses the toner images T onto the sheet P as described below, for example. The method for fusing the toner images T to the sheet P by the image forming apparatus 10 is not limited to the one described below.

For example, the image sensor 23 of the reader 12 illustrated in FIG. 1 reads a document to produce image data. The CPU 61 illustrated in FIG. 2 reads and executes an image generation control program for the image forming unit 31 and a fusing control program for the fuser device 46 from the ROM 62.

The CPU 61 processes the produced image data. The CPU 61 controls the image generation control circuit 67 by the image generation control program to generate electrostatic latent images on the surfaces of the photosensitive drums 51, and the developers 53 to develop the electrostatic latent images. The primary transfer roller 54 primarily transfers the toner images T to the intermediate transfer belt 34. The secondary transfer roller 43 secondarily transfers the toner images T to the sheet P.

The CPU 61 obtains information about the size of the sheet P from a line sensor that detects the size of the sheet P having passed or from an input to the operation unit 13, for example. The CPU 61 controls the fusing control circuit 68 by the fusing control program to cause at least one of the heating elements 87 located where the sheet P passes to generate heat.

Specifically, at least one of the switching elements 68*a* in FIG. 4, corresponding to the heating element 87 located where the sheet P passes, is turned on. As a result, the heating element 87 corresponding to the size of the sheet P is applied with current and generate heat, raising the surface temperature of the heater 71. For example, when the sheet P having an A4R size passes through the fuser device 46, the fusing control circuit 68 causes the heating elements 87C and 87D to generate heat.

When the surface temperature of the heater 71 reaches a certain temperature, the sheet P on which the toner images T have been transferred is conveyed to the fuser device 46. In the fuser device 46, the sheet P on which the toner images T have been transferred is heated by at least one of the heating elements 87 and pressed by the pressure roller 74. As a result, the toner images T are melted and fixed onto the sheet P. The heating element 87 corresponding to the size of the sheet P alone generates heat, which reduce unnecessary heat generation and the power consumption of the heater 71 in comparison with all of the heating elements 87 (the entire heater 71 in the main scanning direction) generating heat regardless of the size of the sheet P.

Figure 8:
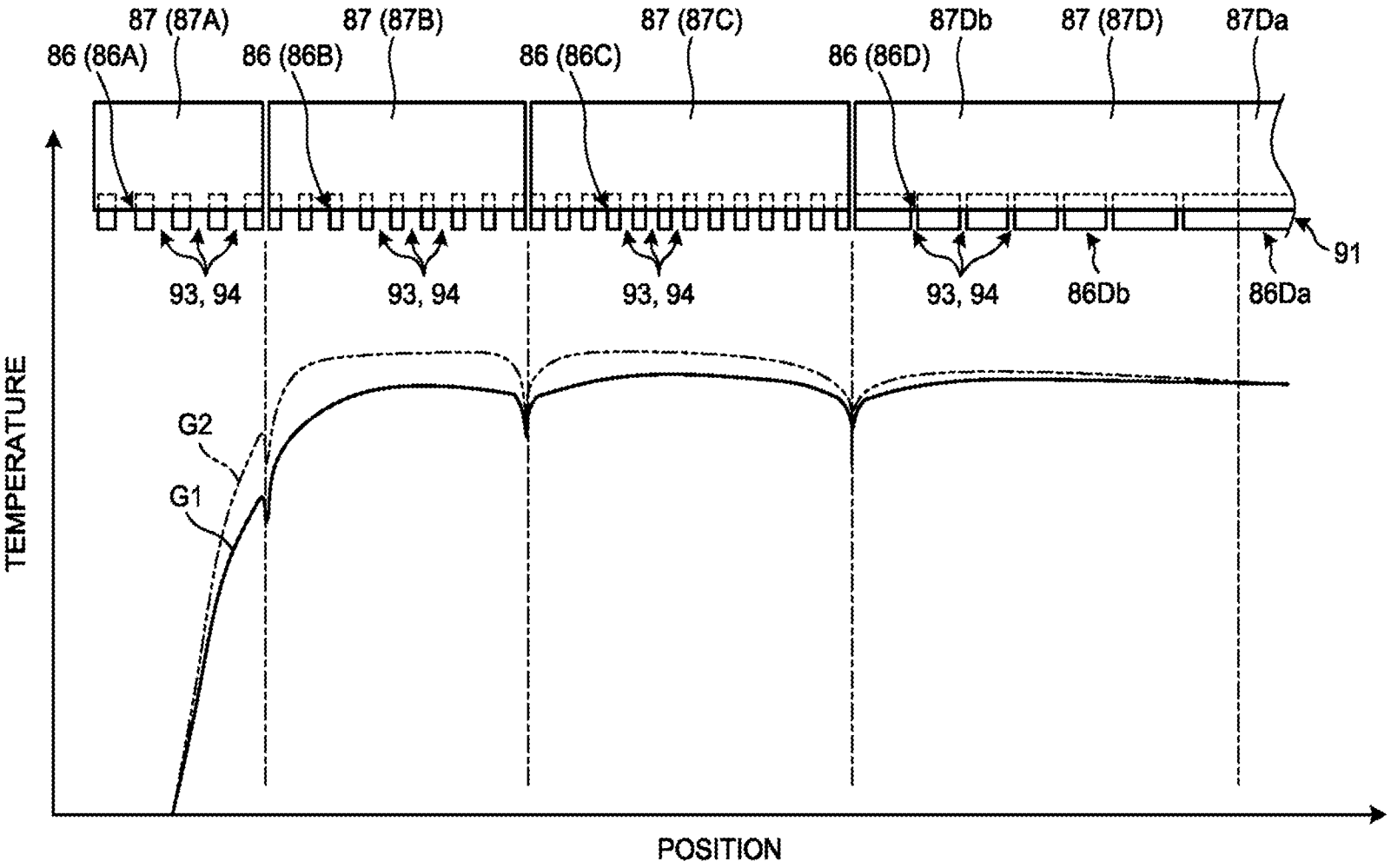
FIG. 8 is an exemplary diagram schematically illustrating the second conductors and temperature distributions of the heating elements in the embodiment.

FIG. 8 is an exemplary diagram schematically illustrating the temperature distributions of the second conductors 86 and the heating elements 87 in the embodiment. The graph G1 indicated by the solid line in FIG. 8 is exemplary temperature distributions of the heating elements 87A, 87B, 87C, and 87D in the embodiment at the respective positions corresponding to the second conductors 86A, 86B, 86C, and 86D. The graph G2 indicated by the two-dot chain line in FIG. 8 is exemplary temperature distributions of the heating elements 87A, 87B, 87C, and 87D when the second conductors 86A, 86B, 86C, and 86D are not divided but are continuous.

As illustrated in FIG. 8, the heating element 87B connected to the second conductor 86B exhibits a larger amount of heat generation and a larger temperature rise per applied voltage to the second wire 83 than the heating element 87A connected to the second conductor 86A. For example, among the heating elements 87 the heating element 87A located at the end radiates a larger amount of heat than the heating element 87B located between the heating elements 87A and 87C. Thereby, a difference in temperature occurs between the heating elements 87A and 87B.

The heating element 87B connected to the second conductor 86B exhibits a larger amount of heat generation and a larger temperature rise per applied voltage to the second wire 83 than the heating element 87C connected to the second conductor 86C. The heating element 87C connected to the second conductor 86C exhibits a larger amount of heat generation and a larger temperature rise per applied voltage to the second wire 83 than the heating element 87D connected to the second conductor 86D. The shorter distance from the heating elements 87 to the terminal 83*a* is, the lower the resistance on the second wires 83 is, for example. This causes differences in temperature among the heating elements 87B, 87C, and 87D.

The open area ratio of the second conductor 86B is set to be larger than the open area ratio of the second conductor 86A in accordance with the distributions of the amount of heat generation and the temperature rise. The open area ratio of the second conductor 86B is set to be larger than the open area ratio of the second conductor 86C and that of the second conductor 86D. The open area ratio of the second conductor 86C is set to be larger than the open area ratio of the second conductor 86D.

The openings 93 work to reduce the applied current to the heating element 87B, resulting in reducing the temperature of the heating element 87B approximately to the temperatures of the heating elements 87C and 87D as illustrated in graphs G1 and G2. Due to the openings 93, the applied current to the heating element 87C is also reduced, reducing the temperature of the heating element 87C approximately to the temperature of the heating element 87D. Consequently, the temperatures of the heating elements 87 become uniform.

As illustrated in the graphs G1 and G2, the heating element 87D exhibits variation in the amount of heat generation and the temperature rise in the Y-axis direction. In the following, for the purpose of explanation, one part of the heating element 87D is referred to as a first heating part 87Da while another part of the heating element 87D is referred to as a second heating part 87Db. In FIG. 8, the first heating part 87Da and the second heating part 87Db are separated by the dot-and-dash line.

The first heating part 87Da and the second heating part 87Db are aligned in the Y-axis direction. In other words, the heating element 87D is divided into the first heating part 87Da and the second heating part 87Db in the Y-axis direction.

The second heating part 87Db is located closer to the heating element 87C than the first heating part 87Da is. In addition, the second heating part 87Db is located closer to the terminal 83*a* of the second wire 83 than the first heating part 87Da is. The second heating part 87Db exhibits a larger amount of heat generation and a larger temperature rise per applied voltage to the terminal 83*a* than the first heating part 87Da.

The second conductor 86D includes a part 86Da connected to the first heating part 87Da and a part 86Db connected to the second heating part 87Db. A ratio of the size of the opening 93 in the part 86Db of the second conductor 86D to the size of the part 86Db (open area ratio of the part 86Db) is larger than a ratio of the opening 93 in the part 86Da of the second conductor 86D to the size of the part 86Da (open area ratio of the part 86Da). For example, the part 86Db connected to the heating element 87D that generates a larger amount of heat is provided with a larger number of grooves 94 than the other part of the second conductor 86D, and thus has a larger open area ratio.

In the embodiment, the part 86Db of the second conductor 86D is provided with the grooves 94. The part 86Da of the second conductor 86D is however continuous in the Y-axis direction with no grooves 94. Since the size of the opening 93 in the part 86Da is zero, the open area ratio of the part 86Db is larger than the open area ratio of the part 86Da. The part 86Da of the second conductor 86D may be provided with at least one groove 94.

The first wire 82, the second wires 83, the insulation layer 84, the first conductor 85, the second conductors 86, the heating elements 87, and the protection layer 88 are formed from a raw material on the substrate 81 by ink jet printing, for example. The heater 71 may be produced by various methods besides ink jet printing.

The first wire 82, the second wires 83, the first conductor 85, and the second conductors 86 are made of silver and platinum, for example. The insulation layer 84 and the protection layer 88 are made of glass to which inorganic oxide filler such as aluminum is added, for example. The heating elements 87 are made of Ta—$SiO_2$, for example. Each of the first wire 82, the second wires 83, the insulation layer 84, the first conductor 85, the second conductors 86, the heating elements 87, and the protection layer 88 may be made of another material in addition to those described above.

In the image forming apparatus 10 in the embodiment, the second conductors 86 are aligned with spacing in the Y-axis direction. At least one of the second conductors 86 is provided with the opening 93. The heating elements 87 are apart from the second wires 83. The heating elements 87 are apart from one another and connected to the second conductors 86 and the first conductor 85. By switching the second conductors 86 that apply currents to the heating elements 87 in accordance with the size of the sheet P, for example, the power consumption of the fuser device 46 can be reduced. Owing to the opening 93, the cross-sectional area of the connection between the second conductor 86 with the opening 93 and the heating element 87 can be reduced, thereby reducing the flow of current between the second conductor 86 and the heating element 87. This can reduce the flow of current through the heating element that generates a larger amount of heat to reduce variation in the amounts of heat generation and the temperatures of the heating elements 87 and to equalize those.

The ratio of the size of the opening 93 to the size of the second conductors 86 is set to larger than the ratio of the size of the gaps 92 between two respective adjacent second conductors 86 to the size of the second conductors 86. Thereby, the larger-size opening 93 can contribute to further reducing the flow of current through the heating element 87 that is connected to the second conductor 86 and generates a larger amount of heat.

The second conductor 86 provided with the opening 93 includes the partial conductors 95 that are aligned in the Y-axis direction apart from one another with the opening 93 interposed therebetween. This makes it possible to increase the size of the opening 93 to further reduce the flow of current through the heating element 87 that is connected to the second conductor 86 and generates a larger amount of heat.

The opening 93 includes the grooves 94 that are aligned in the Y-axis direction at regular intervals between the partial conductors 95. This makes it possible to equalize the amount of currents flowing between the second conductors 86 and the heating elements 87 in the Y-axis direction. As a result, the amounts of heat generation of the heating elements 87 connected to the second conductors 86 can be equalized in the Y-axis direction.

The ratio of the size of the opening 93 of the second conductor 86B to the size of the second conductor 86B is set to larger than the ratio of the size of the opening 93 of the second conductor 86A to the size of the second conductor 86A. This makes it possible to further reduce the amount of heat generation of the heating element 87B connected to the second conductor 86B than that of the heating element 87A connected to the second conductor 86A. This also makes it possible to further reduce the flow of current through the heating element 87B that generates a larger amount of heat, to reduce the variation in the amounts of heat generation and the temperatures of the heating elements 87 and to equalize those, for example.

The heating element 87A is connected to the second conductor 86A. The heating element 87B, which generates a larger amount of heat per applied voltage to the terminal 83*a* than the heating element 87A, is connected to the second conductor 86B. The opening 93 in the second conductor 86B serves to further reduce the flow of current through the heating element 87B that generates a larger amount of heat per applied voltage to the terminal 83*a*, thereby making it possible to reduce the variation in the amounts of heat generation and the temperatures of the heating elements 87 and to equalize those.

The heating element 87D includes the first heating part 87Da and the second heating part 87Db that generates a larger amount of heat per applied voltage to the terminal 83*a* than the first heating part 87Da. Of the second conductor 86D, the ratio of the size of the opening 93 in the part 86Db connected to the second heating part 87Db to the size of the part 86Db is set to larger than the ratio of the size of the opening 93 in the part 86Da connected to the first heating part 87Da to the size of the part 86Da. This can further reduce the flow of current through the second heating part 87Db that generates a larger amount of heat per applied voltage to the terminal 83*a* to reduce the variation in the amount of heat generation and the temperature distribution of the heating element 87D in the Y-axis direction and to equalize those.

In the row 91 of the second conductors 86 in the Y-axis direction, the second conductor 86A is located at the end, the second conductor 86B is adjacent to the second conductor 86A, and the second conductor 86C is adjacent to the second conductor 86B. Thus, the heating element 87A connected to the second conductor 86A located at the end of the row 91 radiates heat more greatly than the heating element 87B connected to the second conductor 86B located between the second conductors 86A and 86C. Further, the ratio of the size of the opening 93 in the second conductor 86B to the size of the second conductor 86B is set to larger than the ratio of the size of the opening 93 in the second conductor 86A to the size of the second conductor 86A. Owing to the opening 93 of the second conductor 86B, the flow of current through the heating element 87B connected to the second conductor 86B can be reduced to reduce the variation in the amounts of heat generation and the temperatures of the heating elements 87 and to equalize those.

A voltage is equally applied to the second wires 83. The openings 93 in the second conductors 86 work to reduce the flow of current into the heating elements 87, thereby making it possible to reduce the variation in the amounts of heat generation and the temperature distributions of the heating elements 87 in the Y-axis direction and to equalize those.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fuser device, comprise:

a substrate;

a first conductor that extends in a first direction;

a plurality of second conductors that are apart from the first conductor in a second direction, and aligned with spacing in the first direction, at least one of the second conductors being provided with an opening, the second direction being along one surface of the substrate and intersecting the first direction;

a first wire that is laid on the surface and connected to the first conductor;

a plurality of second wires that is laid on the surface, apart from the first wire, and connected to the second conductors;

a plurality of heating elements that is apart from the second wires, apart from one another, connected to the second conductors and the first conductor, and generates heat when applied with current; and a roller that applies pressure to a medium on which a toner image is generated, the medium being heated by at least one of the heating elements.

2. The fuser device according to claim 1, wherein a ratio of a size of the opening to a size of the second conductors is larger than a ratio of a size of a gap between two adjacent second conductors of the second conductors to the size of the second conductors.

3. The fuser device according to claim 1, wherein the at least one of the second conductors provided with the opening includes a plurality of partial conductors that is aligned apart from each other via the opening in the first direction.

4. The fuser device according to claim 1, wherein the second conductors include a first divided conductor provided with the opening and a second divided conductor provided with the opening, and a ratio of a size of the opening of the second divided conductor to a size of the second divided conductor is larger than a ratio of a size of the opening of the first divided conductor to a size of the first divided conductor.

5. The fuser device according to claim 4, wherein the heating elements include a first heating element and a second heating element, the first heating element being connected to the first divided conductor, the second heating element that is connected to the second divided conductor and generates a larger amount of heat per applied voltage to the second wires than the first heating element.

6. The fuser device according to claim 1, wherein the second conductors include a divided conductor provided with the opening, one of the heating elements connected to the divided conductor includes a first heating part and a second heating part that is aligned with the first heating part in the first direction and generates a larger amount of heat per applied voltage to the second wires than the first heating part, and of the divided conductor, a ratio of a size of the opening in a part connected to the second heating part to a size of the part connected to the second heating part is larger than a ratio of a size of the opening in a part connected to the first heating part to a size of the part connected to the first heating part.

7. The fuser device according to claim 1, wherein the second conductors are in a row in the first direction and include a first divided conductor, a second divided conductor, and a third divided conductor, the first divided conductor being located at an end of the row and provided with the opening, the second divided conductor being adjacent to the first divided conductor in the row and provided with the opening, the third divided conductor being adjacent to the second divided conductor in the row, and a ratio of a size of the opening of the second divided conductor to a size of the second divided conductor is set to larger than a ratio of a size of the opening of the first divided conductor to a size of the first divided conductor.

8. The fuser device according to claim 1, wherein the second wires are equally applied with voltage.

9. An image forming apparatus, comprising the fuser device according to claim 1.

* * * * *